US008375877B2

(12) United States Patent
Nelson et al.

(10) Patent No.: US 8,375,877 B2
(45) Date of Patent: Feb. 19, 2013

(54) CONFORMAL ROLLER FURLER ASSEMBLY AND METHOD

(76) Inventors: Barry Nelson, Richmond Heights, MO (US); Rick Nelson, Pleasanton, CA (US)

( * ) Notice: Subject to any disclaimer, the term of this patent is extended or adjusted under 35 U.S.C. 154(b) by 163 days.

(21) Appl. No.: 12/646,902

(22) Filed: Dec. 23, 2009

(65) Prior Publication Data

US 2010/0288175 A1 Nov. 18, 2010

Related U.S. Application Data

(60) Provisional application No. 61/140,498, filed on Dec. 23, 2008.

(51) Int. Cl.
*B63H 9/04* (2006.01)

(52) U.S. Cl. ..... 114/106

(58) Field of Classification Search ..... 114/104–107
See application file for complete search history.

(56) References Cited

U.S. PATENT DOCUMENTS 5,014,637 A * 5/1991 Stevenson, IV ..... 114/106
5,315,948 A * 5/1994 Brown ..... 114/106

* cited by examiner

*Primary Examiner* — Stephen Avila
(74) *Attorney, Agent, or Firm* — Dean A. Craine

(57) ABSTRACT

A roller furler assembly for furling a sail where the luff is vertically or diagonally supported by a stay cable. The assembly includes a hollow drive shaft longitudinally aligned around the stay cable adjacent to the luff. A drive mechanism is coupled to the lower end of the drive shaft. Integrally formed or connected to the drive shaft is a torque input device that connects to a portion of a hollow, flexible sail edge device fitted over the middle and upper sections of the drive shaft. The sail edge device includes a longitudinally aligned slot or track that directly connects to a beaded edge attached to the luff. The torque input device is approximately 5%-25% of the stay cable so when the drive shaft is rotated, torque or rotational force is applied directly to the section of the luff located perpendicular to the longitudinal axis of the torque input device.

10 Claims, 9 Drawing Sheets

CONFORMAL ROLLER FURLER ASSEMBLY AND METHOD

This utility patent application is based on and claims the filing date benefit of the U.S. provisional patent application (Ser. No. 61/140,498), filed on Dec. 23, 2008.

BACKGROUND OF THE INVENTION

1. Field of the Invention

This invention pertains to an apparatus and method for furling and reefing a sail.

2. Description of the Related Art

The roller furler concept originated in earlier generation of sail powered vessels as a method of managing staysails. A staysail is generally a triangular shaped sail whose leading edge is supported by a flexible cable or rod under tension. Staysails are known by various names such as, but not limited to Jibs, Genoas, Yankees, Gennekers, Code 0s, In-mast Furling Mainsails, and the like. A roller furler is a mechanical device which winds the staysail around the tensioned edge cable.

The original concept was conceived to provide two functions. The first function, known as 'furling', provides storage of the sail when not deployed. This aspect of the concept allows a simple method to set or strike a staysail. Prior art has produced many concepts which serve this function. The second function, known as 'reefing', was seen as an additional benefit. Reefing is the common term for an operation which partially stores a sail and thereby reduces the amount of a sail exposed to an air stream. The purpose of this reduction in sail area is to reduce the power being generated by the sail commensurate with stability of the sailing vessel. It is common for sailing vessels to be overwhelmed by excess wind pressure.

Prior art for the reefing function has not been entirely successful. Sails are constructed with a three dimensional curvature to produce precise airfoil shapes with highly efficient lift-to-drag ratio when properly supported and exposed to an air stream. This three dimensional curvature presents geometric difficulties for prior art. Rolling a three dimensional curved surface around an essentially straight stay cable normally causes severe distortion of the efficient airfoil shape. Past attempts to reef a sail have produced such distorted sail aerodynamic properties that the sail no longer produces the necessary efficient lift to propel the boat in a close-hauled angle of motion. This loss in close-hauled (upwind) performance reduces the vessel's operational safety margins when navigating in proximity to obstructions or in inclement weather.

Prior art devices generally wind a sail from a mechanism driving a more or less torsionally rigid hollow sail mounting track fitted over the stay cable. This rigid hollow sail mounting track rotates the entire luff edge of the sail in a uniform motion, (i.e. all at once). The result of this method is to generate shear stresses in the sail as it is partially rolled (reefed). This shear stress causes sail material to accumulate in the midsection of the sail, thereby producing exaggerated camber and severe distortion in the airfoil shape.

Prior art devices have included upper swivel assemblies that insufficiently maintain alignment and position engagement with the sail mounting tracks. This upper swivel device provides an attachment between the sail halyard and the sail. To accommodate the winding of the sail, the swivel device must allow the sail to swivel freely around the sail mounting track and or the leading edge support cable with the halyard being tensioned. As the sail is wound or furled, the sail attachment portion of the swivel device rotates. When rotation occurs, the load on the swivel device becomes skewed causing torque inputs that increase friction and may eventually damage the contact points (typically in the sail mounting tracks). This increased friction, may also cause a condition known as "Halyard wrap", where the upper swivel device does not "rotationally isolate" the sail from the halyard and where, during winding, the halyard is undesirably wound around the stay cable.

A second failure mode is when the sail mounting track becomes positioned inadequately high on the stay cable. During operation, the upper swivel device slides along the sail-mounting track until the sail is fully hoisted. If the resulting position of a fully hoisted sail and upper swivel extends beyond the height of the sail-mounting track, it can become disengaged. When this occurs, the sail cannot be lowered and the boat becomes in jeopardy.

SUMMARY OF THE INVENTION

Disclosed herein is a conformal roller furler assembly for furling a sail that balances the winding forces necessary to reef the sail with the panel stresses present in the airfoil shaped compound curvatures of the sail. One object of the invention is to create a state of dynamic equilibrium between the winding force and the sail's airfoil shape.

More specifically, the roller furler assembly is used for reefing a sail where the luff is vertically or diagonally supported by a stay cable. The furler includes a hollow drive shaft longitudinally aligned around the stay cable. Attached to the lower end of the drive shaft is a drive mechanism used to selectively rotate the drive shaft around the stay cable. Integrally formed or connected to the upper section of the drive shaft is a torque input device that connects to and re-enforces a hollow, flexible sail edge device that is longitudinally aligned over the upper and middle sections of the drive shaft. The sail edge device includes a longitudinally aligned track that connects to webbing attached to the sail's luff. In one embodiment, the drive shaft extends upward from the drive mechanism and inside a hollow bore formed inside the sail edge device to a point in the sail edge device approximately level with the sail's geometric center. The length of the torque input device is also less than the length of the sail edge device and between 5% to 25% of the overall length of the stay cable. The upper and lower ends of the sail edge device are detached from the drive shaft thereby enabling the ends of the sail edge device to axially twist. The sail edge device is made of flexible, medium stiffness, high impact resistance plastic alloy of material such as PVC, polyester, nylon, polycarbonate with a modulus of elasticity in the range of 275,000 psi so that when the drive shaft is rotated, torque or rotational force is directly transferred to the section of luff located adjacent to the torque input device and perpendicular to the sail's geometric center. Because the upper and lower ends of the sail edge device are not attached to the drive shaft or to the torque input device, when the drive shaft is rotated, the upper and lower sections of the sail edge device are able to axially twist which reduces automatically and adjusts the pulling forces exerted on the luff so that the sail remains taut and maintains its aerodynamic properties.

A key feature of the assembly is that the sail edge device is coupled to the drive shaft closer to the sail's geometric center rather than the corners of the sail, thereby winding the sail beginning from the section of the sail where the camber is greatest and where the torque input device is located and then progressively extending above and below the torque input device attachment area in a manner compliant to the rotational torque input and the sail properties.

During operation, the upper and lower swivels allow sail to wind independent of the sail's head and tack connections which are attached to the upper and lower swivels, respectively. When the twisting or torque limit of the sail edge device is reached, the sail is taut and the entire sail is then wound onto the sail edge device.

In one embodiment, the roller furler assembly includes an optional improved upper swivel with an alignment tube that slides over the sail edge device thereby holding the upper swivel longitudinally aligned over the stay cable.

DESCRIPTION OF THE PREFERRED EMBODIMENT(S)

Referring to the accompanying Figs, there is shown a conformal sail roller furler assembly 10 which permits the sail 90 to be wound around a stay cable 15 that torsionally adjusts to the sail stresses and compound curvatures as it is furled reefed and thereby maintaining the sail 90 in an aerodynamic airfoil shape.

Figure 4:
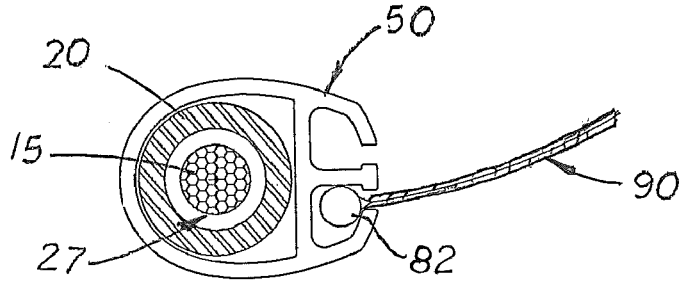
FIG. 4 is a cross-sectional view taken along line 4-4 in FIG. 1, showing a sectional plan view of the sail edge device with the drive shaft extending through the sail edge device's main passageway and the stay cable extending through the bore formed in the drive shaft.
Figure 5:
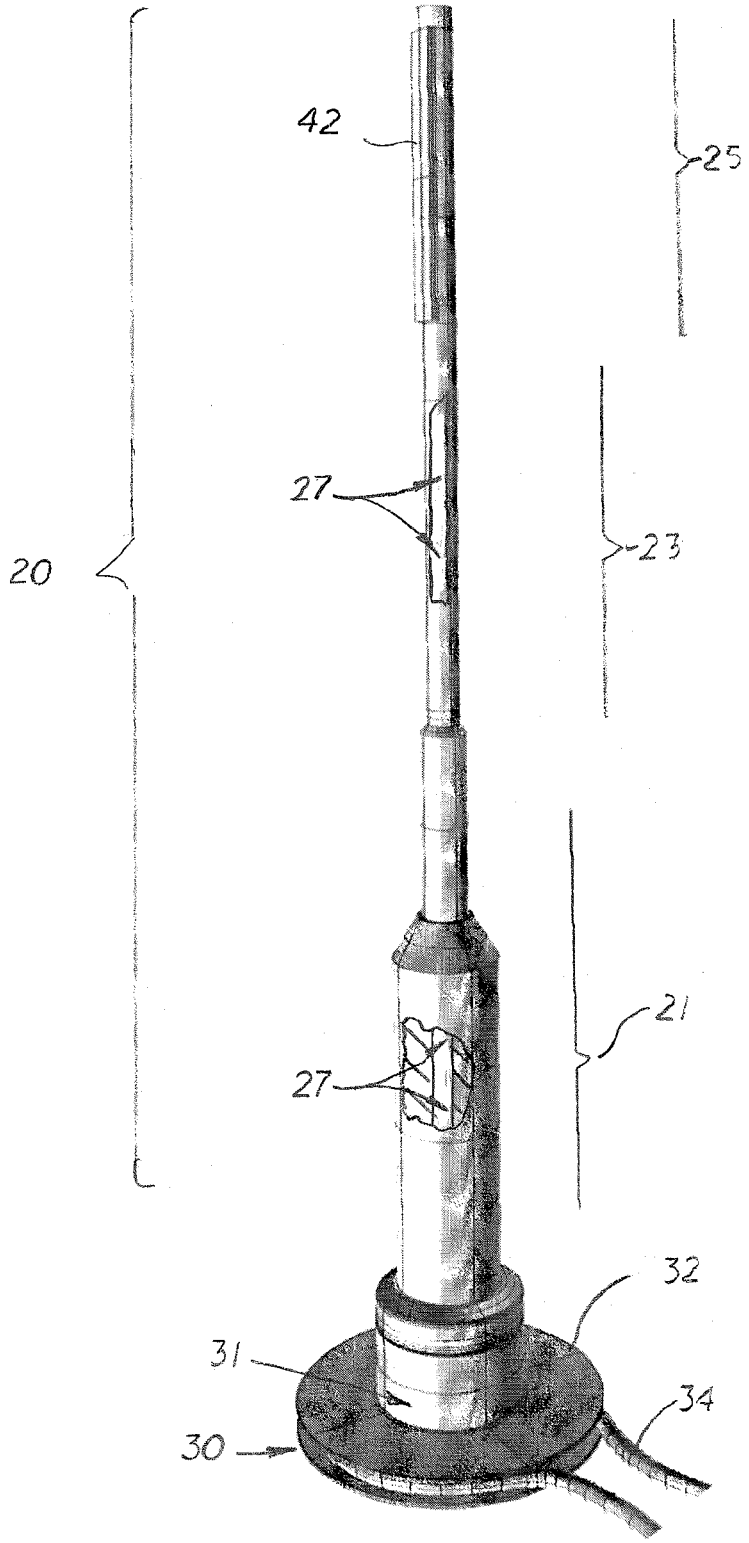
FIG. 5 is a perspective view of the drive shaft.
Figure 6:
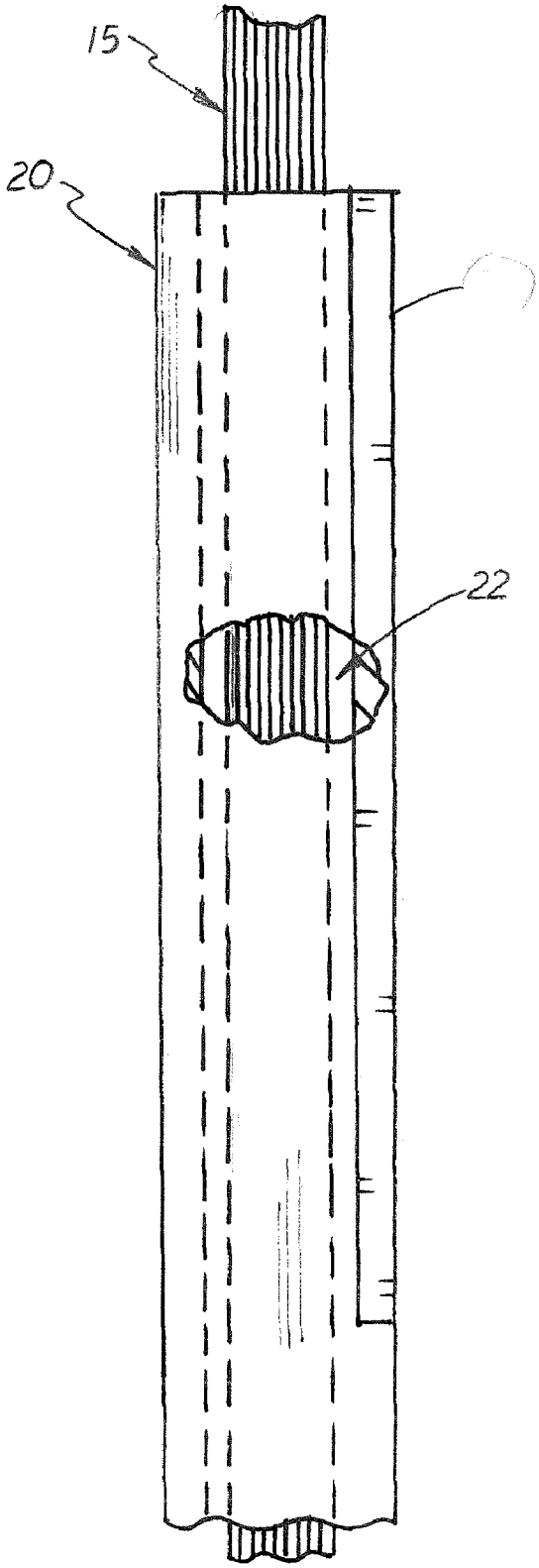
FIG. 6 is a sectional side elevational view of the upper section of the drive shaft with a key formed on its back edge and the stay cable extending through the bore formed in the drive shaft.

The conformal roller furler assembly 10 consists of a circular hollow drive shaft 20 fabricated from a rigid material of a high modulus of elasticity, which is longitudinally aligned and fitted around the stay cable 15. As shown in FIGS. 4 and 5, the drive shaft 20 includes a longitudinal aligned bore 27 through which the stay cable 15 is extended. During operation, the drive shaft 20 is able to rotate around the stay cable 15 and is securely attached at its lower end to a rotary drive mechanism, generally indicated by the reference number 30.

Figure 1:
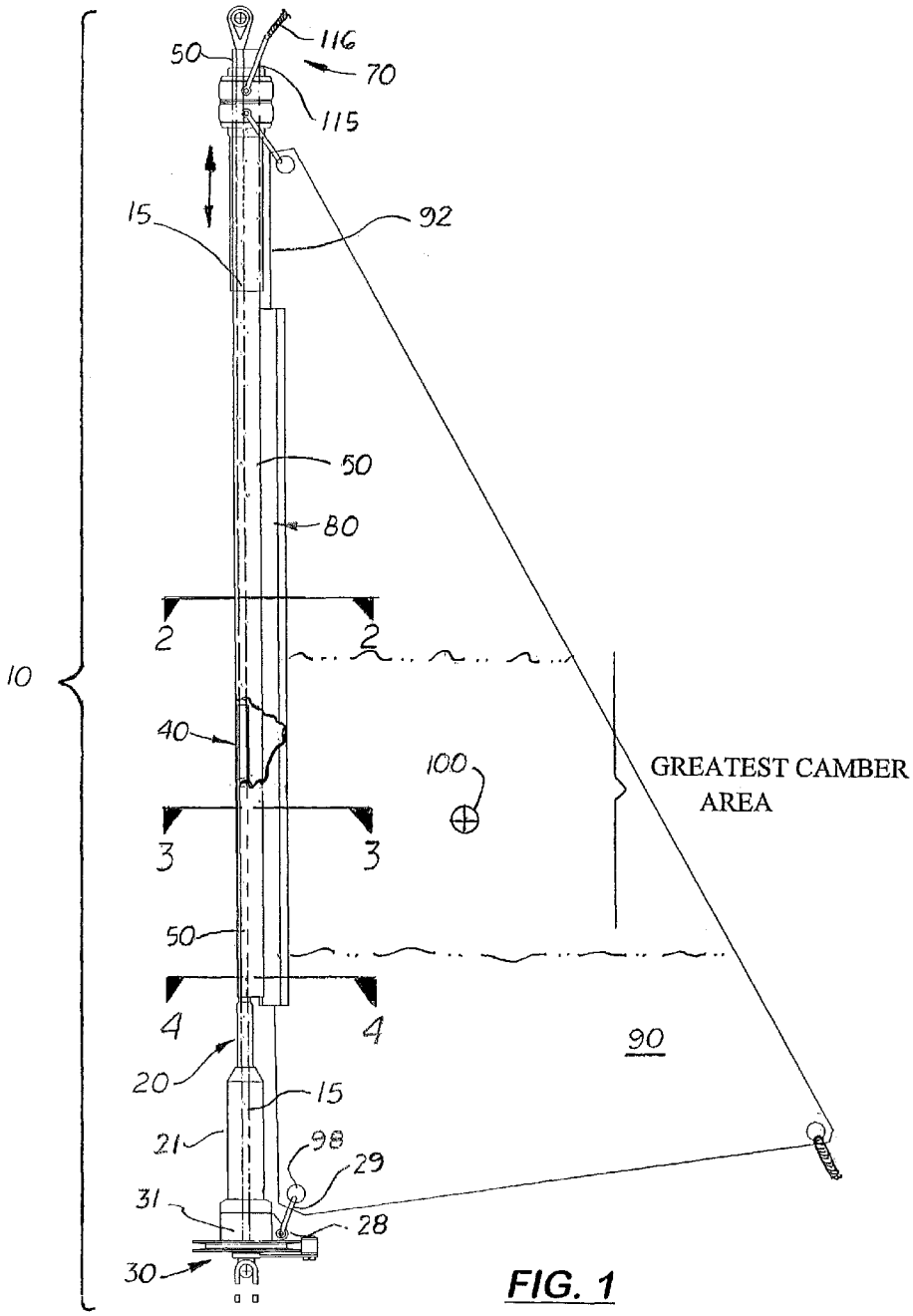
FIG. 1 is a side view of a roller furler assembly with a sail attached thereto.

As shown in FIG. 5, the drive shaft 20 is made up of three sections—a lower section 21, a middle section 23 and an upper section 25. Disposed around the lower section 21 and over the drive mechanism 30 is a lower swivel 31. In the embodiment shown herein, the drive mechanism 30 is made up of a large pulley 32 attached or formed on the lower end of the lower section 21 that connects to a rope 34 that causes the entire drive shaft 20 to be rotated in either direction. As shown in FIG. 1, formed on the lower swivel 31 is an extension arm 28 to which a clip 29 is attached that attaches to a hole 98 formed on the sail's tack. It should be understood that the invention is not limited by this particular type of rotary drive mechanism and that it may be used with other types of rotary drive mechanisms, such as a pawl and socket systems.

Coupled or formed on the upper section 25 of the drive shaft 20 is a torque input device, generally indicated by the reference number 40. During use, the torque input device 40 is used to couple the upper section 25 of the drive shaft 20 to the middle section 50A of the sail edge device 50 that is longitudinally aligned and extends over the drive shaft 20 and stay cable 15. In the embodiment shown, the torque input device 40 is an elongated, rectangular-shaped key 42 designed to fit into the main passageway 56 formed on the sail edge device 50.

Figure 2:
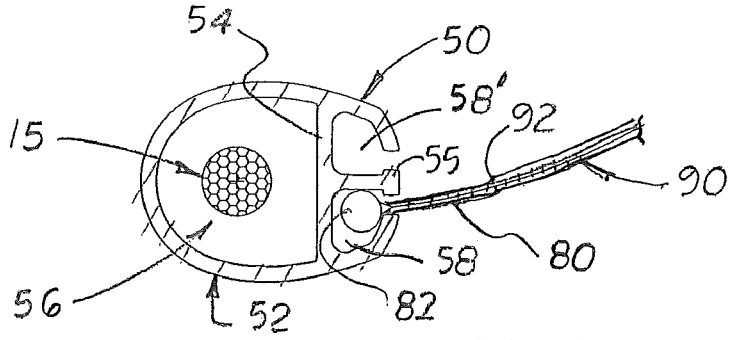
FIG. 2 is a cross-sectional view taken along line 2-2 in FIG. 1, showing a sectional plan view of the sail edge device with the bead attached to the slot and the stay cable extending through the main passageway.
Figure 3:
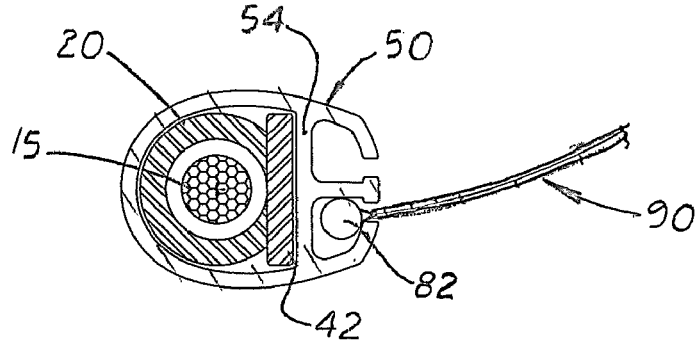
FIG. 3 is a cross-sectional view taken along line 3-3 in FIG. 1, showing a sectional plan view of the sail edge device with the drive shaft extending through the main passageway, the stay cable extending through the drive shaft, and a coupling key located between the drive shaft and the transverse member that couples the rotational movement of the drive shaft and sail edge device.

As shown in FIGS. 2-4, the sail edge device 50 includes a hollow elongated tube 52 with a transverse wall 54 and a dorsal wall 55 perpendicular to the transverse wall 54. Together, the walls 54 and 55 divides the tube 52 into longitudinally aligned passageways—a main passageway 56 and two track passageways 58, 58'. The main passageway 56 is sufficient in diameter so that the drive shaft 20 with the key 42 may extend therein, (see specifically FIG. 3). The transverse wall 54 is substantially flat and longitudinally aligned so that when the drive shaft 20 and the key 42 are extended into the main passageway 56, the key 42 abuts against the transverse wall 54 thereby rotatably coupling the upper section 25 of the drive shaft 20 via the key 42 to the adjacent section on the sail edge device 50.

The sail edge device 50 extends longitudinally over the middle section 23 and upper section 25 of the drive shaft 20 and under the alignment tube 76 on the upper swivel 70 that attaches to the upper end of the sail 90 and the sail hoisting rope, also called a halyard 116. During use, when the drive shaft 20 is rotated, the key 42 applies a rotational force to the transverse wall 54 on the inside surface of the sail edge device 50 The sail edge device 50 is specifically designed to twist and thereby absorb and release rotational energy to the sail's luff 92 when furling or reefing the sail 90. In one embodiment of the invention, the sail edge device is made of flexible, medium stiffness, high impact resistance plastic alloy of materials such as PVC, Polyester, Nylon, Polycarbonate with a modulus of elasticity in the range of 275,000 psi. The wall thickness is approximately 1.5 to 3.0 mms. (0.060 to 0.100 inches). It should be understood however, that the sail edge device 50 is not limited to these materials or wall thicknesses.

Sewn or adhesively attached to the luff 92 is reinforced webbing 80. The webbing 80 includes a continuous, longitudinally aligned beaded edge 82 that slides into one of the tracks 58 or 58' on the sail edge device 50 to securely attach the luff 92 to the sail edge device 50. In the embodiment shown in FIG. 1, the webbing 80 extends from the upper edge of the drive shaft's lower section 21 to a location on the sail edge device 50 just below the alignment tube 76 on the upper swivel 70.

As shown more clearly in FIG. 1, the length of the drive shaft 20 and the length and location of the torque input device 40 on the drive shaft 20 are sufficient so that a large portion of the torque input device 40 is substantially level with or lateral to the sail's geometric center 100. Generally, the geometric center 100 is located in a region of the sail 90 that has the greatest camber as shown in FIG. 1. More specifically, experiments have shown that for most sails, the length of the torque input device 40 should be approximately 5% to 50% of the length of the luff 92.

As shown more clearly in FIG. 1, the length of the drive shaft 20 and the length and location of the torque input device 40 on the drive shaft 20 are sufficient so that a large portion of the torque input device 40 is substantially level with or lateral to the sail's geometric center 100. Generally, the geometric center 100 is located in a region of the sail that has the greatest camber as shown in FIG. 1. More specifically, experiments have shown that for most sails, the length of the torque input device 40 should be approximately 5% to 50% of the length of the luff.

Figure 7:
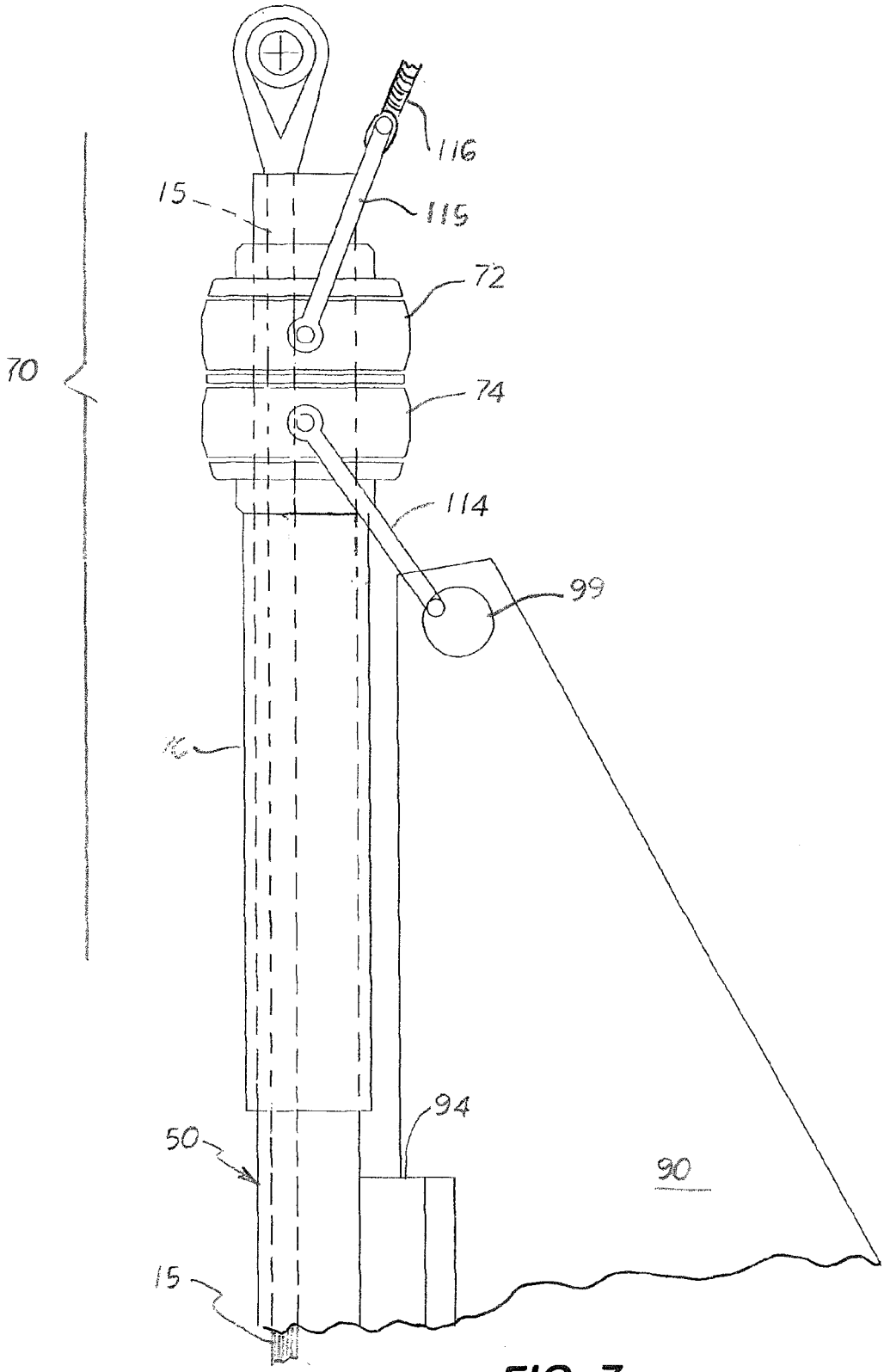
FIG. 7 is a side elevational view of the upper swivel.

FIG. 7 is a side elevation view of the upper swivel 70 that includes two collars 72, 74 mounted on the end of a hollow alignment tube 76. Attached to the lower rotating collar 74 is a clip 114 that extends diagonally downward and engages a hole 99 formed on the head of the sail 90. The stay cable 15 extends through the two collars 72, 74 and the alignment tube 76. The top collar 72 includes a second clip 115 that attaches to the halyard 116, which is used to manually raise and lower the upper swivel 70 on the stay cable 15. The upper end of the sail edge device 50 extends into the alignment tube 76 and above the top collar 72 thereby helping to keep the swivel 70 longitudinally aligned over the stay cable 15 at all times. The benefits of using an alignment tube 76 are that it more evenly distributes the applied loads, maintains more precise axial alignment of the components, and reduces the risk of disengagement of the upper swivel 70 from the sail edge device 50 if the sail edge device 50 becomes positioned too low.

When it is desirable to furl or reef the sail 90, the operator inputs torque into the drive mechanism 30. The resulting torque is transferred through the drive shaft 20 to the sail edge device 50 via the torque input device 40 at the approximate geometric center 100 of the sail 90. The winding action initiates at the location of the section of the luff 92 adjacent to the torque input device 40 and then proceeds up and down the webbing 80 and the luff 92 in proportion to stress on the sail 90. In other words, the sail 90 is wound from the vicinity of the geometric center 100 earlier than it is near the corners of the sail 90. The assembly 10 permits the sail 90 to reef and furl differentially in proportion to the variable tension loads along the edge of the sail 90.

Figure 8:
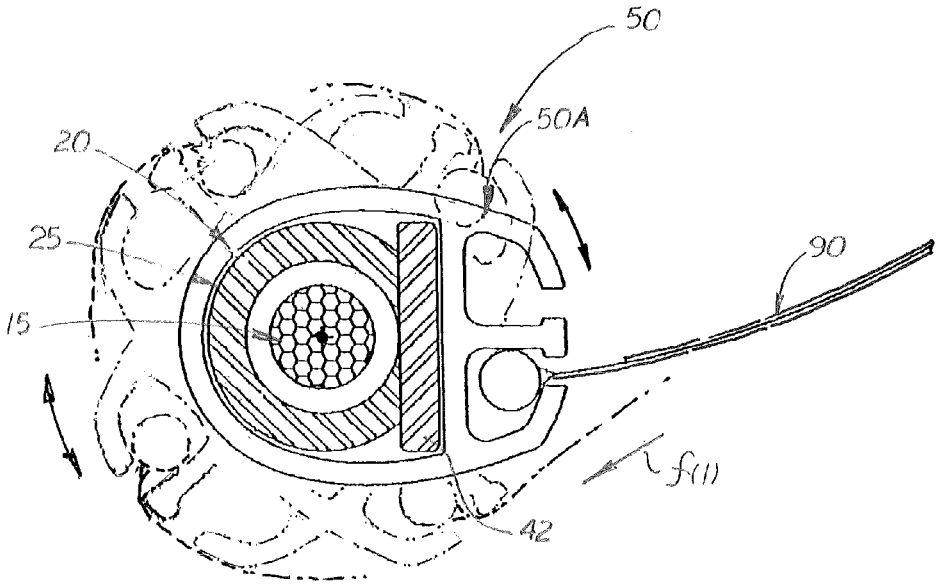
FIG. 8 is an illustration showing the 360 degree rotation of the middle section of the sail edge device restrained by the drive shaft and the key formed or attached to the drive shaft.

A key feature of the device is that while the middle section 50A of the sail edge device 50 is directly connected to the drive shaft 20 via the torque input device 40, the opposite sections 50B, 50C of the sail edge device 50 are not directly attached to the drive shaft 20. FIG. 8 is an illustration showing the 360 degree rotation of the middle section (indicated by reference number 50A) of the sail edge device 50 that is restrained by the drive shaft 20 with a key 42. When the drive shaft 20 is rotated, a force f(1) is applied to the section of the sail 90 (also the section with the greatest camber) immediately adjacent to the key 42.

Figure 9:
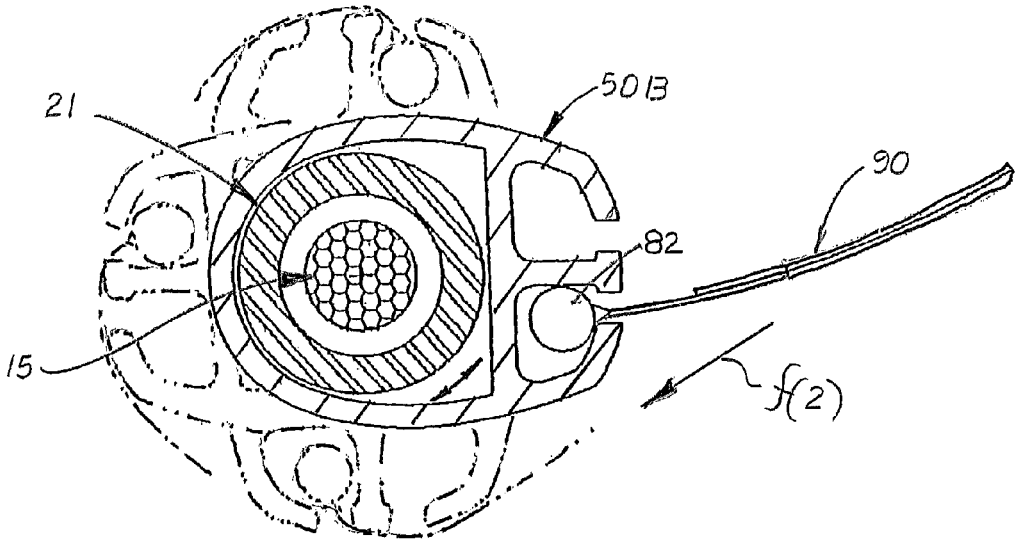
FIG. 9 is an illustration showing the 360 degree rotation of the lower section of the sail edge device and being longitudinally restrained by the lower section of the drive shaft that surrounds the stay cable and is free to rotate about the drive shaft.

FIG. 9 is an illustration showing the 360 degree rotation of the lower section (indicated by the reference number 50B) of the sail edge device 50 retained by the middle section 23 of the drive shaft 20 that surrounds the stay cable 15. During operation, the longitudinal axis of the sail edge device 50 remains substantially aligned over the drive shaft's and the stay cable's longitudinal axis. Additionally this illustration shows how the lower section 50B of the sail edge device 50 is able to rotate around the drive shaft 20 and thereby allowed to twist to apply a reduced pulling force f(2) on the adjacent section of sail 90.

Figure 10:
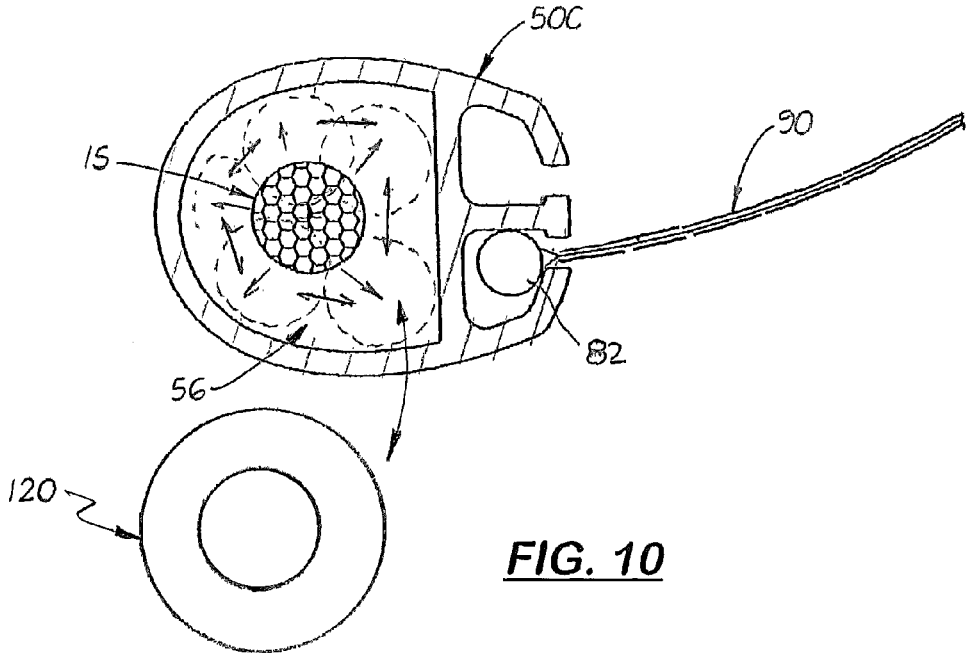
FIG. 10 is an illustration of the upper section of the sail edge device showing the stay cable is able to 'float' or move side-to-side and fore and aft directions inside the main passageway of the sail edge device or containing an optional bushing placed inside the main passageway to keep the uppers section of the sail edge device longitudinally aligned over the stay cable.

FIG. 10 is an illustration of the upper section (indicated by the reference number 50C) of the sail edge device 50 showing how the stay cable 15 is able to 'float' or move side-to-side and fore and aft directions inside the main passageway 56 of the sail edge device 50. FIG. 10 also shows the insertion of an optional bushing 120 placed inside the main passageway 56 used to keep the upper section 50C of the sail edge device 50 longitudinally aligned over the stay cable 15 during use.

Figure 11:
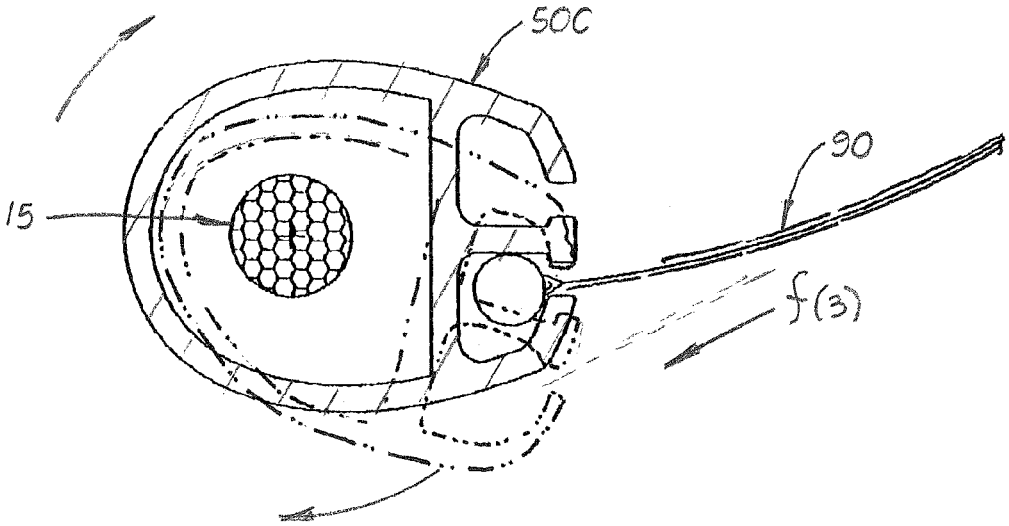
FIG. 11 is an illustration showing how the top section of the sail edge device partially twists and distorts its shape when rotated and pulling the luff.

FIG. 11 is an illustration showing how the upper section 50C of the sail edge device 50 not supported by the drive shaft 20 or by the key 42 and therefore, can twist around the stay cable 15 and reduce the pulling force f(3) it exerts on the adjacent section of sail 90.

The stay cable 15 is typically ⅛ to ¾ inch in diameter. The drive shaft measures 8 to 30 feet in length and 7/16 to 2 inches in diameter depending on the size of the sail. The sail edge device 50 is approximately 70 to 90% of the stay cable 15 with the lower end of the sail edge device 50 being elevated to accommodate the wide lower section of the drive shaft 20, the lower swivel and the drive mechanism 30. The length of the key 42 is approximately 5% to 25% of the overall length of the stay cable 15.

In summary, a roller furler assembly 10 is described for furling a sail 90 where the luff 92 is vertically or diagonally supported by a stay cable 15. The assembly 10 includes a hollow drive shaft 20 longitudinally aligned around the stay cable 15 adjacent to the luff 92. A drive mechanism 30 is coupled to the lower end of the drive shaft 20. Integrally formed or connected to the drive shaft 20 is a torque input device 40 that connects to and re-enforces a hollow, flexible sail edge device 50 fitted over the drive shaft 20 and over the stay cable 15. The sail edge device 50 includes at least one longitudinally aligned track 58 that directly connects to a bead edge 82 connected to the luff 92. The length of the torque input device 40 is less than the length of the sail edge device 50 so that the opposite ends of the sail edge device 50 connected to the sail luff 92 are not directly coupled to torque input device 40. The lengths of the drive shaft 20, the torque input device 40 and the sail edge device 50 are sufficient however, so that when the drive shaft 20 is rotated, torque or rotational force is applied to the section of the luff 92 located laterally to the sail's geometric center 100. The sail edge device 50 is hollow with relatively thin side walls and made of material that allows the detached ends to twist and deform when normal sail stress are applied during winding. This feature enables the sail 90 to be kept taut and to maintain its aerodynamic properties while the sail 90 is furled or reefed.

Using the above assembly 10, a method is provided for furling and reefing a sail so that the wound and unwound portions of the sail remains essentially equally taut thereby maintaining the aerodynamic properties, comprising the following steps:

a. selecting a roller furler assembly that includes a stay cable, a drive shaft extending over the stay cable, a drive mechanism coupled to the drive shaft, an elongated sail edge device that extends over said drive shaft, said sail edge device being coupled to said drive shaft at a location aligned with the geometric center of the sail, said sail edge device being attached to the luff, said assembly also includes an upper swivel attached to a sail hoisting rope and connected to the head of the sail, and a lower swivel vertically aligned with the drive shaft and connected to the tack of the sail;

b. selecting a fore and aft sail with a luff, a head and a tack;

c. attaching the sail edge device to the luff of a sail at a location aligned with the sail's geometric center and the upper swivel to the head and the lower swivel to the tack; and, d. selectively rotating the drive mechanism to apply an adjusting, conformal winding pressure along the length of the luff thereby maintaining the sail aerodynamically taut.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

We claim:

1. A sail roller furler assembly for furling or unfurling a sail with a luff and a geometric center, the roller furler comprising:

a. a sail with a head, a tack, a luff, beaded edge located along said luff, and a geometric center;

b. a stay cable;

c an elongated drive shaft extending over said stay cable, said drive shaft includes a lower section, a middle section, an upper section, a lower end and an upper end;

d. a drive mechanism coupled to said lower end of said drive shaft;

e. a hollow, elongated sail edge device longitudinally aligned with and extending around said drive shaft, said sail edge device configured to attach to said beaded edge located alone on said luff, said sail edge device includes an upper section, a middle section, and a lower section, said middle section of said sail edge device being rotatably coupled to said upper section of said drive shaft and said upper section and said lower section of said sail edge device being rotatably detached from said drive shaft, said sail edge device also configured and made of flexible, medium modulus of elasticity material that enables said sail edge device to axially twist and thereby absorb and release rotational energy exerted thereto by said drive mechanism and said sail when said sail is reefed so that the unfurled section of said sail maintains taut and in an airfoil, aerodynamic configuration;

f. an upper swivel longitudinally aligned with said stay cable and connected to said head of said sail; and, g. a lower swivel longitudinally aligned with said stay cable and connected to said tack of said sail.

2. The sail roller furler assembly, as recited in claim 1, wherein said sail upper swivel includes an alignment tube and said sail edge device extends upward and over said stay cable and under said alignment tube thereby holding said upper swivel and said sail edge device longitudinally aligned over said stay cable.

3. The sail roller furler assembly, as recited in claim 1, wherein said sail edge device is rotatably coupled to said drive shaft by a longitudinal key formed on or affixed to said drive shaft and fits into a complimentary-shaped main passageway formed on sail edge device thereby rotatably locking said sail edge device onto said drive shaft.

4. The sail roller furler assembly, as recited in claim 3, wherein said sail upper swivel includes an alignment tube that extends downward over said stay cable and said sail edge device thereby holding said upper swivel and said sail edge device longitudinally aligned over said stay cable.

5. The sail roller furler assembly, as recited in claim 1, wherein said sail edge device is rotatably coupled to said drive shaft by a longitudinal key that longitudinally slides into a complimentary main passageway formed on said sail edge device.

6. The sail roller assembly, as recited in claim 1, wherein said sail edge device includes a longitudinally aligned main passageway that receives and rotatable locks said sail edge device to said drive shaft and at least one longitudinally aligned track that receives said luff edge of said sail.

7. The sail roller furler assembly, as recited in claim 6, wherein said drive shaft includes a longitudinal key that longitudinally slides into said main passageway formed on said sail edge device and rotatably locks said sail edge device onto said drive shaft.

8. A sail roller furler assembly for furling or unfurling a sail, comprising:

a. a sail with a head, a tack, a luff with a continuous beaded edge, and a geometric center;

b. a stay cable;

c. an elongated drive shaft extending over said stay cable, said drive shaft includes a lower end and an upper section;

d. a drive mechanism coupled to said lower end of said drive shaft;

e. a hollow, elongated sail edge device attached to said beaded edge on said luff on said sail, said sail edge device being longitudinally aligned with and extending around said drive shaft, said sail edge device being configured and made of flexible, medium modulus of elasticity material that allows said sail edge device to twist when a rotating force is applied to the middle section of said sail edge device and forces exerted by said sail are exerted to said lower section and said upper section of said sail edge device when said sail is reefed; and, f. a torque input means located between said upper section of said drive shaft and said middle section of said sail edge device to rotatably couple said drive shaft and said sail edge device together, said torque input means being aligned with said geometric center of said sail.

9. The sail roller furler assembly, as recited in claim 8, wherein said sail upper swivel includes an alignment tube and said sail edge device extends upward and over said stay cable and under said alignment tube thereby holding said upper swivel and said sail edge device longitudinally aligned over said stay cable.

10. A method for furling and unfurling a sail so that the sail remains essentially, equally taut and aerodynamic, comprising the following steps:

a. selecting a roller furler assembly that includes a stay cable, a drive shaft extending over the stay cable, a drive mechanism coupled to the drive shaft, an elongated sail edge device configured to rotate around and extends longitudinally over said drive shaft, said drive shaft includes an upper section and said sail edge device includes a middle section, said assembly also includes a torque input device disposed between said drive shaft and said elongated sail edge device to rotatably couple said upper section of drive shaft and said middle section of said sail edge device together, said sail edge device is configured and made of flexible medium stiffness material with a modulus of elasticity sufficient to allow twisting when attached to said sail;

b. selecting a sail with a luff, a head, a tack, and a geometric center;

c. attaching said sail edge device to said luff of said sail;

d. coupling said middle section of said sail edge device to said upper section of said drive shaft at a location aligned with said geometric center of said sail using said torque input device e. selectively rotating said drive mechanism causing said sail edge device coupled thereto to rotate and axially twist to reef said sail and leaving any exposed unreefed portions of said sail in an airfoil, 1 aerodynamic configuration.

* * * * *